US007148869B2

(12) United States Patent
Chen et al.

(10) Patent No.: US 7,148,869 B2
(45) Date of Patent: Dec. 12, 2006

(54) DRIVING CIRCUIT OF A LIQUID CRYSTAL DISPLAY AND RELATING DRIVING METHOD

(75) Inventors: Cheng-Jung Chen, Miao-Li Hsien (TW); Yuhren Shen, Tai-Nan (TW); Liang-Chen Chien, Chia-Yi Hsien (TW)

(73) Assignee: Vestview Technology Inc., Hsin-Chu (TW)

( * ) Notice: Subject to any disclaimer, the term of this patent is extended or adjusted under 35 U.S.C. 154(b) by 595 days.

(21) Appl. No.: 10/707,384

(22) Filed: Dec. 9, 2003

(65) Prior Publication Data

US 2005/0099549 A1 May 12, 2005

(30) Foreign Application Priority Data

Oct. 8, 2003 (TW) ..... 92127999 A

(51) Int. Cl.
*G09G 3/36* (2006.01)

(52) U.S. Cl. ..... 345/89

(58) Field of Classification Search ..... 345/89, 345/690, 600; 348/674; 359/519
See application file for complete search history.

(56) References Cited

U.S. PATENT DOCUMENTS 5,729,297 A * 3/1998 Kwon ..... 348/458
5,910,796 A 6/1999 Gormish
6,100,879 A 8/2000 Da Costa
6,611,249 B1 8/2003 Evanicky et al.
7,081,906 B1 * 7/2006 Kim et al. ..... 345/690
2002/0063666 A1 5/2002 Kang et al.
2003/0095090 A1 5/2003 Ham
2003/0098839 A1 5/2003 Lee

FOREIGN PATENT DOCUMENTS

EP 0 961 260 A2 12/1999
EP 0 961 260 A3 3/2000
JP H04-318516 11/1992
JP H07-056532 3/1995
JP 2002-082657 A 3/2002
WO WO-99/05567 2/1999

* cited by examiner

*Primary Examiner*—Richard Hjerpe
*Assistant Examiner*—Kevin M. Nguyen
(74) *Attorney, Agent, or Firm*—Winston Hsu

(57) ABSTRACT

A driving method of a liquid crystal display (LCD) includes (a) measuring reaction curves of LCD panel pixels switching from any gray scale value to others within a frame period and generating a standard table according to the results, (b) measuring adjustment gray scale values of any gray scale values for different gammas, (c) generating a plurality of tables according to the adjustment gray scale values and the standard table, (d) applying scan voltages to the scan lines, (e) receiving image data from an image signal terminal, (f) delaying the image data for a frame period to generate delayed image data, (g) selecting a table from the standard table and the tables according to gamma, and (h) selecting an image data value from the selected table according to the current and delayed image data to generate a data line voltage to be applied on a corresponding data line.

8 Claims, 8 Drawing Sheets

DRIVING CIRCUIT OF A LIQUID CRYSTAL DISPLAY AND RELATING DRIVING METHOD

BACKGROUND OF INVENTION

1. Field of the Invention

The invention relates to a driving circuit of a liquid crystal display and its relating driving method, and more particularly, to a driving circuit with its gamma adjustable and having a lookup table (LUT), and its relating driving method.

2. Description of the Prior Art

A liquid crystal display (LCD) has advantages of lightweight, low power consumption, and low divergence and is applied to various portable equipment such as notebook computers and personal digital assistants (PDAs). In addition, LCD monitors and LCD televisions are gaining in popularity as a substitute for traditional cathode ray tube (CRT) monitors and televisions. However, an LCD does have some disadvantages. Because of the limitations of physical characteristics, the liquid crystal molecules need to be twisted and rearranged when changing input data, which can cause the images to be delayed. For satisfying the rapid switching requirements of multimedia equipment, improving the response speed of liquid crystal is desired.

Please refer to FIG. 1, which is a timing diagram of the pixel voltage and the transmission rate V1 according to a prior art LCD. In FIG. 1, the pixel voltage is shown with the straight lines, and the transmission rate V1 is shown with a dotted line. In FIG. 1, frame N means a frame period, and frame N+1, N+2 . . . mean the following frame periods. Due to the physical characteristics of liquid crystal molecules, when the pixel voltage is switched from a data voltage C1 to a data voltage C2, the liquid crystal molecules cannot be twisted to a predetermined angle within a single frame period, resulting in failure to perform at a predetermined transmission rate. As the curve of the transmission rate V1 shows, the transmission rate V1 cannot reach a predetermined transmission rate until the frame period of frame N+2. The delayed response-time will cause blurring on the LCD.

An over-driving method is utilized to improve the response-time. Please refer to FIG. 2, which is a timing diagram of the pixel voltage and the transmission rate V2 according to a prior art LCD using an over-driving method. When the pixel voltage is switched from the data voltage C1 to the data voltage C2, an over-driving data voltage C3 is added to accelerate the response speed of the liquid crystal molecules. Since a higher data voltage can obtain a faster response speed of the liquid crystal molecules, a data voltage C3 that is higher than the data voltage C2 can improve the response-time enough to reach the predetermined transmission rate in a single frame period. As FIG. 2 shows, the curve of the transmission rate V2 reaches the predetermined transmission rate in frame N.

The U.S. published application No. 2002/0050965 discloses an over-driving method using a brief table to store the over-driving image data. The brief table only includes part of the over-driving image data for driving the pixels switched from one gray scale to another. When the driving circuit receives the image data from the input terminal, a processor is used to perform an interpolation operation to expand the brief table. Hence, an extra algorithm is needed in the conventional over-driving method. The effect of using an extra algorithm is that it will slow down the response speed.

In addition, there is no description relating to the adjustment of gamma of an LCD. In the prior art, the overdrive and adjustment of gamma depend respectively on two different circuits, which complicates the whole circuit.

SUMMARY OF INVENTION

It is therefore a primary objective of the claimed invention to provide a driving circuit with an adjustable gamma and an LUT of an LCD along with the relating driving method to solve the problem mentioned above.

Briefly, the present invention provides a driving method of an LCD. The LCD includes an LCD panel; the LCD panel includes a plurality of scan lines, a plurality of data lines, and a plurality of pixels. Each pixel is connected to a corresponding scan line and a corresponding data line, and each pixel comprises a switching device connected to the corresponding scan line and the corresponding data line. The method includes (a) measuring reaction curves of a pixel of the LCD panel switched from any gray scale values to other gray scale values within a frame period and generating a standard table according to the reaction curves measured, (b) measuring adjustment gray scale values of any gray scale values for different gammas, (c) generating a plurality of tables according to the adjustment gray scale values and the standard table, (d) applying scan voltages to the scan lines, (e) receiving image data from an image signal terminal, (f) delaying the image data for a frame period in order to generate delayed image data, (g) selecting a table from the standard table and the tables according to the gamma, and (h) selecting an image data value from the selected table according to the current image data and the delayed image data and generating a data line voltage according to the image data value, applying the generated data line voltage on a corresponding data line.

The present invention further provides a driving circuit for driving an LCD. The driving circuit includes a scan line driving circuit for applying scan voltages to the scan lines, an image signal terminal for receiving image data, an image memory for storing the image data and delaying the image data for a frame period, a memory for storing the plurality of tables, a selector for selecting a table from the plurality of tables according to the gamma, a look up table for selecting an image data value from the selected table according to the current image data and the delayed image data, and a data line driving circuit for generating a data voltage according to the image data value, applying the generated data voltage to a corresponding data line.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
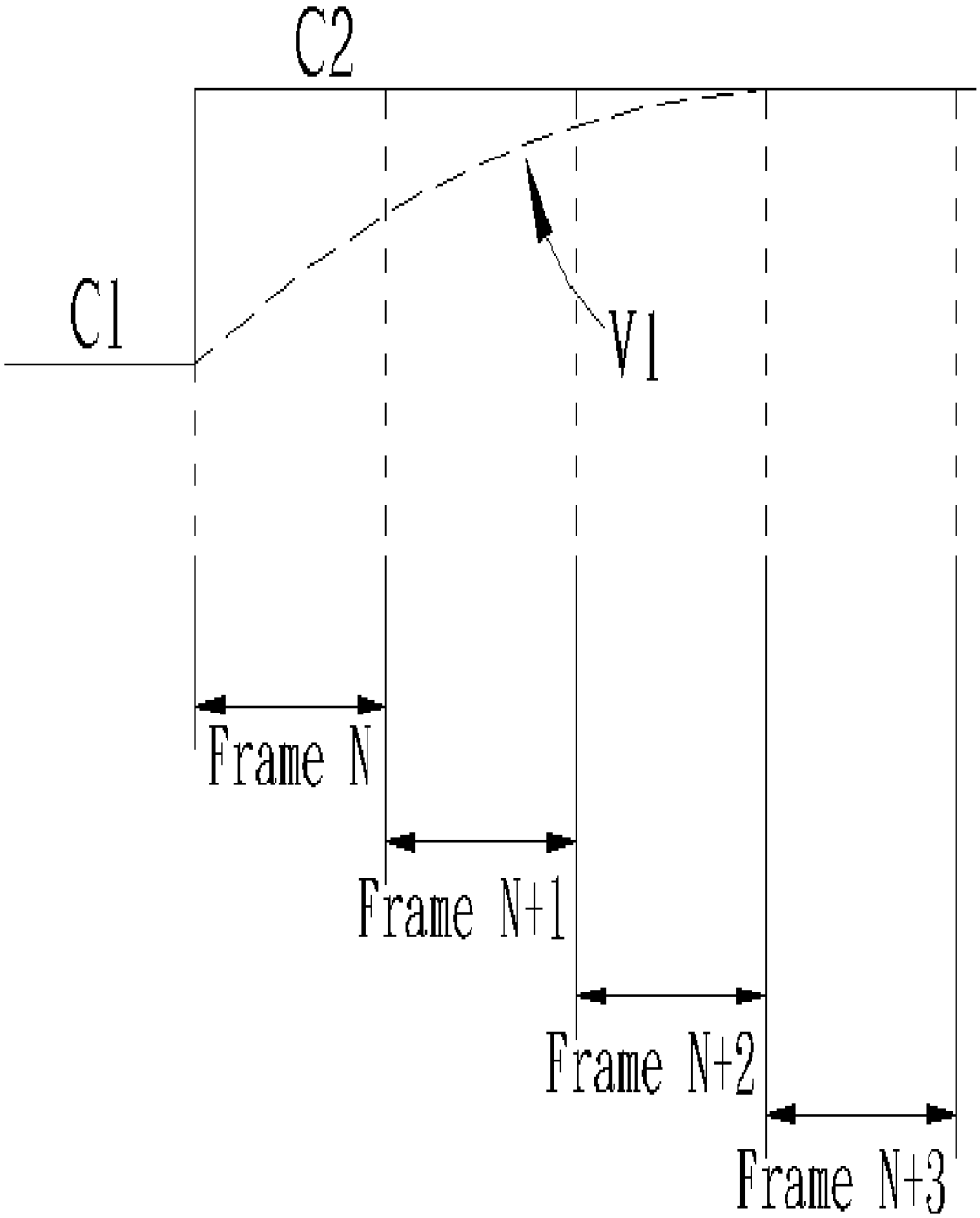
Fig. 1 Prior art
FIG. 1 is a timing diagram of pixel voltage and transmission rate according to prior art.
Figure 2:
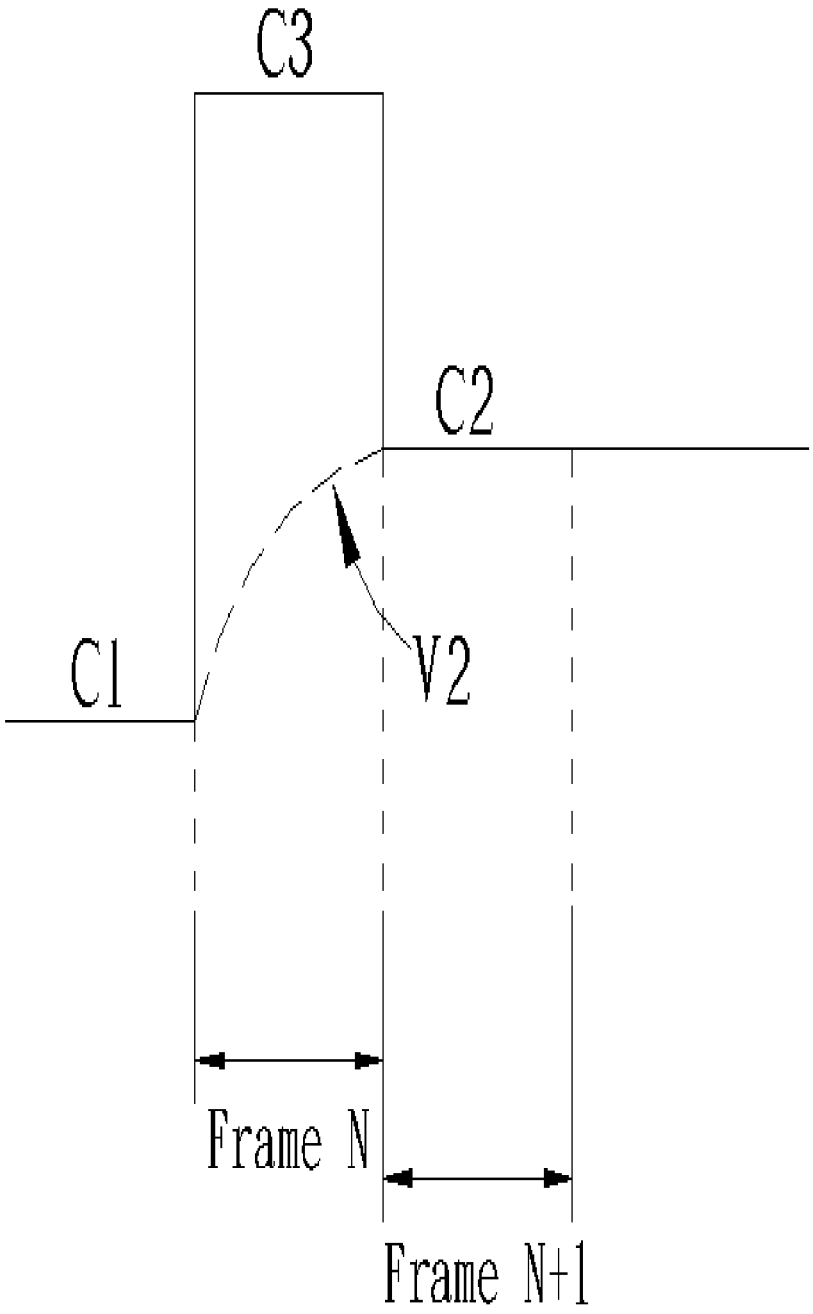
Fig. 2 Prior art
FIG. 2 is a timing diagram of pixel voltage and transmission rate according to prior art using an over-driving method.
Figure 3:
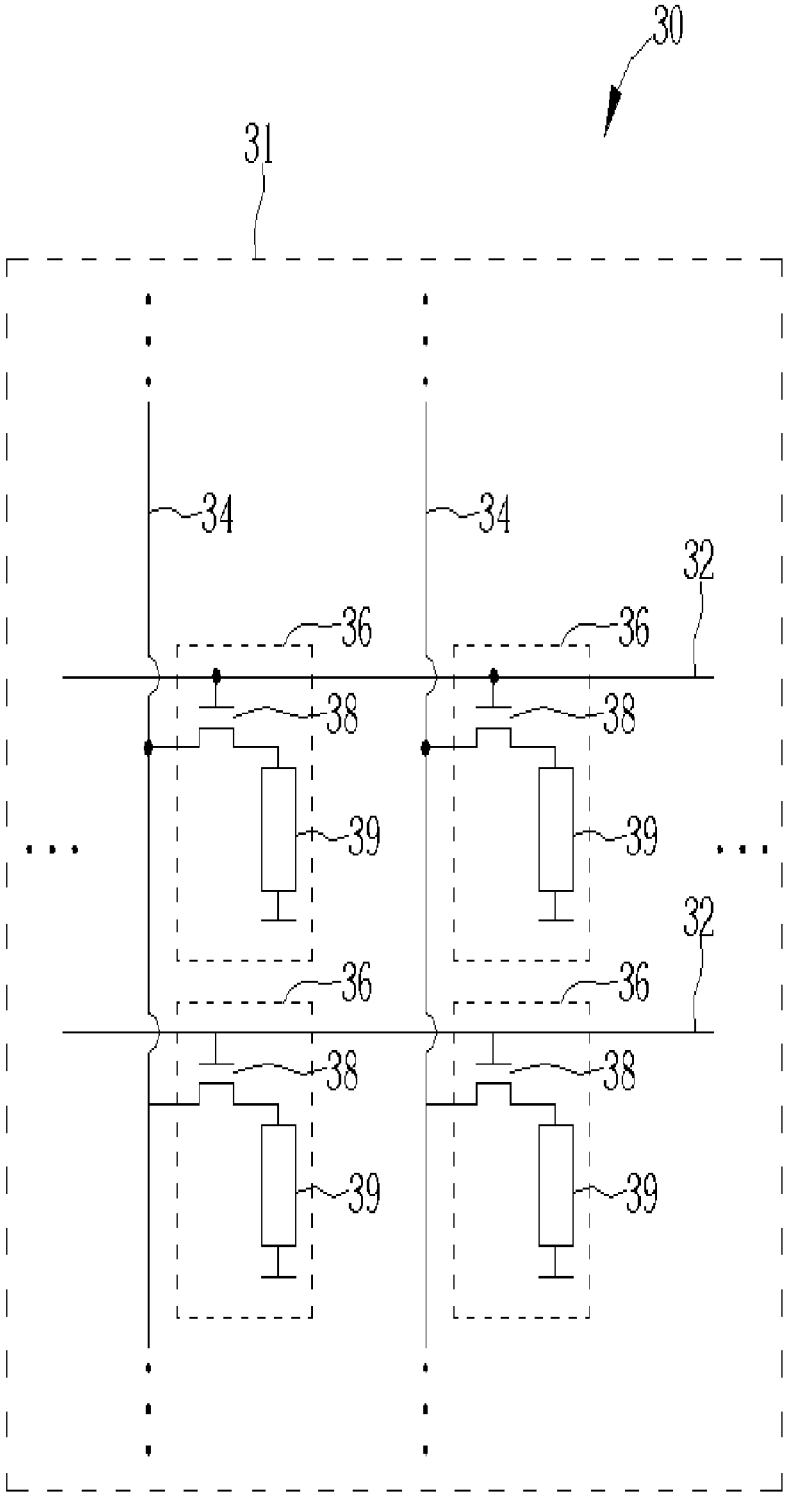
FIG. 3 is a circuit diagram of a typical LCD.

Hereby the operation of an LCD is described in advance. Please refer to FIG. 3, which is a circuit diagram of a typical LCD 30. The LCD 30 comprises an LCD panel 31, and the LCD panel 31 includes a plurality of scan lines 32, a plurality of data lines 34, and a plurality of pixels 36. Each pixel 36 is connected to a corresponding scan line 32 and a corresponding data line 34, and each pixel 36 has a switching device 38 and a pixel electrode 39. The switching device 38 is connected to the corresponding scan line 32 and the corresponding data line 34. To drive the LCD 30, scan voltages are applied to the scan lines 32 to turn on the switching devices 38, and data voltages are applied to the data lines 34 and transmitted to the pixel electrodes 30 through the switching devices 38. Therefore, when the scan voltages are applied to the scan lines 32 to turn on the switching devices 38, the data voltages on the data lines 34 will charge the pixel electrodes 39 through the switch devices 38 thereby, twisting the liquid crystal molecules. When the scan voltages on the scan lines 32 are removed to turn off the switching devices 38, the data lines 34 and the pixels 36 will disconnect, and the pixel electrodes 39 will remain charged. The scan lines 32 turn the switching devices 38 on and off repeatedly so that the pixel electrodes 39 can be repeatedly charged. Different data voltages cause different twisting angles and show different transmission rates. Hence, the LCD 30 displays various images.

Figure 4:
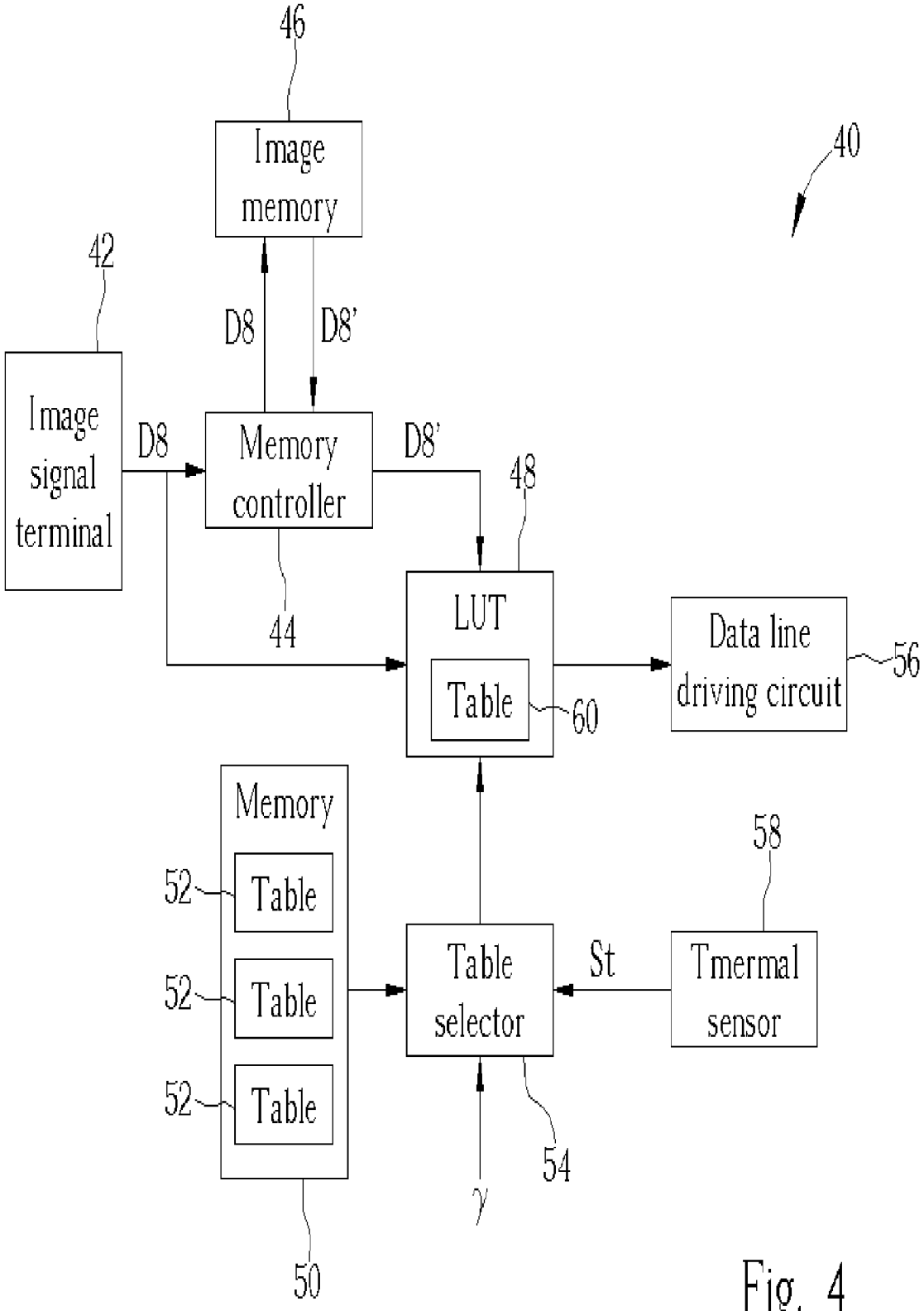
FIG. 4 is a block diagram of a driving circuit according to the present invention.

Please refer to FIG. 4, which is a block diagram of a driving circuit according to the present invention. The driving circuit 40 is for driving the LCD 30 in FIG. 3. The driving circuit 40 includes an image signal terminal 42, a memory controller 44, an image memory 46, an LUT 48, a memory 50, a table selector 54, a data line driving circuit 56, and a thermal sensor 58. In the present embodiment, the image signal terminal 42 respectively transmits 8-bit image data of red, greed and blue (RGB) to the memory controller 44 and the LUT 48. Each group of image data is for controlling the gray scale value of the pixel 30 in red, green or blue. Each color has 256 ($2^8$) gray scales, so that 24 (8*3) bits of image data are required to determine the properties of each pixel 30.

In the present embodiment, one (image data D8) of the 3 groups of image data is used for a further description. First, the image signal terminal 42 transmits the 8-bit image data D8 to the memory controller 44 and the LUT 48. Continuously, the memory controller 44 transmits the image data D8 to the image memory 46 to store, delays the image data D8 for a frame period, and then reads the image data D8 out from the image memory 46 and transmits them to the LUT 48. The image data D8 delayed for a frame period is hereby defined as delayed image data D8. Therefore, the delayed image data D8 and the image data D8 belong to two different frames, and these two image data D8" and D8 are input from the image signal terminal 42 in sequence at an interval of a frame period.

The memory 50 stores a plurality of parameter tables 52. Each table 52 corresponds to different gammas. The driving circuit 40 can select the proper table 52 to use as the LUT 48 to drive the LCD panel 31 according to the gamma. For this reason, a table selector 54 is used to select a table 60 from the plurality of tables 52 according to the gamma and send it to the LUT 48.

Figure 5:
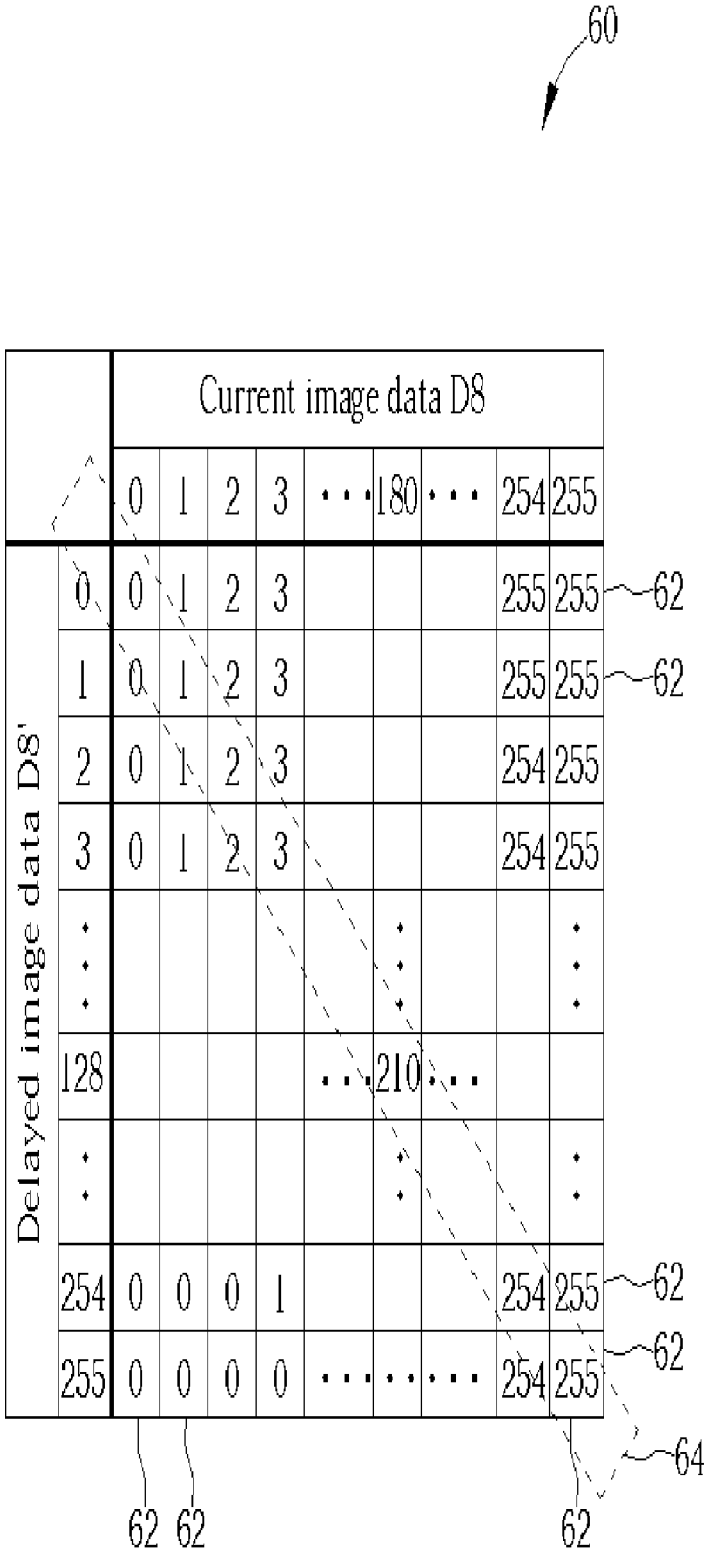
FIG. 5 illustrates a table used by the LUT in FIG. 4.

Please refer to FIG. 5 showing a table 60 used by the LUT 48 in FIG. 4. The table 60 stores ($2^8 \times 2^8$) pieces of 8-bit overdrive image data 62. Each piece of image data 62 corresponds to different combinations of the current image data D8 and the delayed image data D8. The LUT 48 selects an image data value 62 from the table 60, selected by the table selector 54, according to the current image data D8 and the delayed image data D8 and then sends it to the data line driving circuit 56. Continuously, the data line driving circuit 56 generates a data line voltage according to the image data value 62 output from the LUT 48 and applies it to a corresponding data line 34. Take for instance the situation where the delayed image data D8 is 128 and the current image data D8 is 180, i.e. the corresponding pixel 36 is switched from gray scale 128 to gray scale 180. In this case the LUT 48 selects the image data value 62 with a value of 210 from the table 60 according to the current image data D8 and the delayed image data D8. In response, the data line driving circuit 56 generates a data line voltage corresponding to the image data value 62 with a value of 210 and applies it to the corresponding data line 34. In addition, please notice that the selected image data value 62 is larger than the value of the current image data D8 (i.e. 210>180), which means the driving circuit 40 overdrives the pixel 36.

Figure 6:
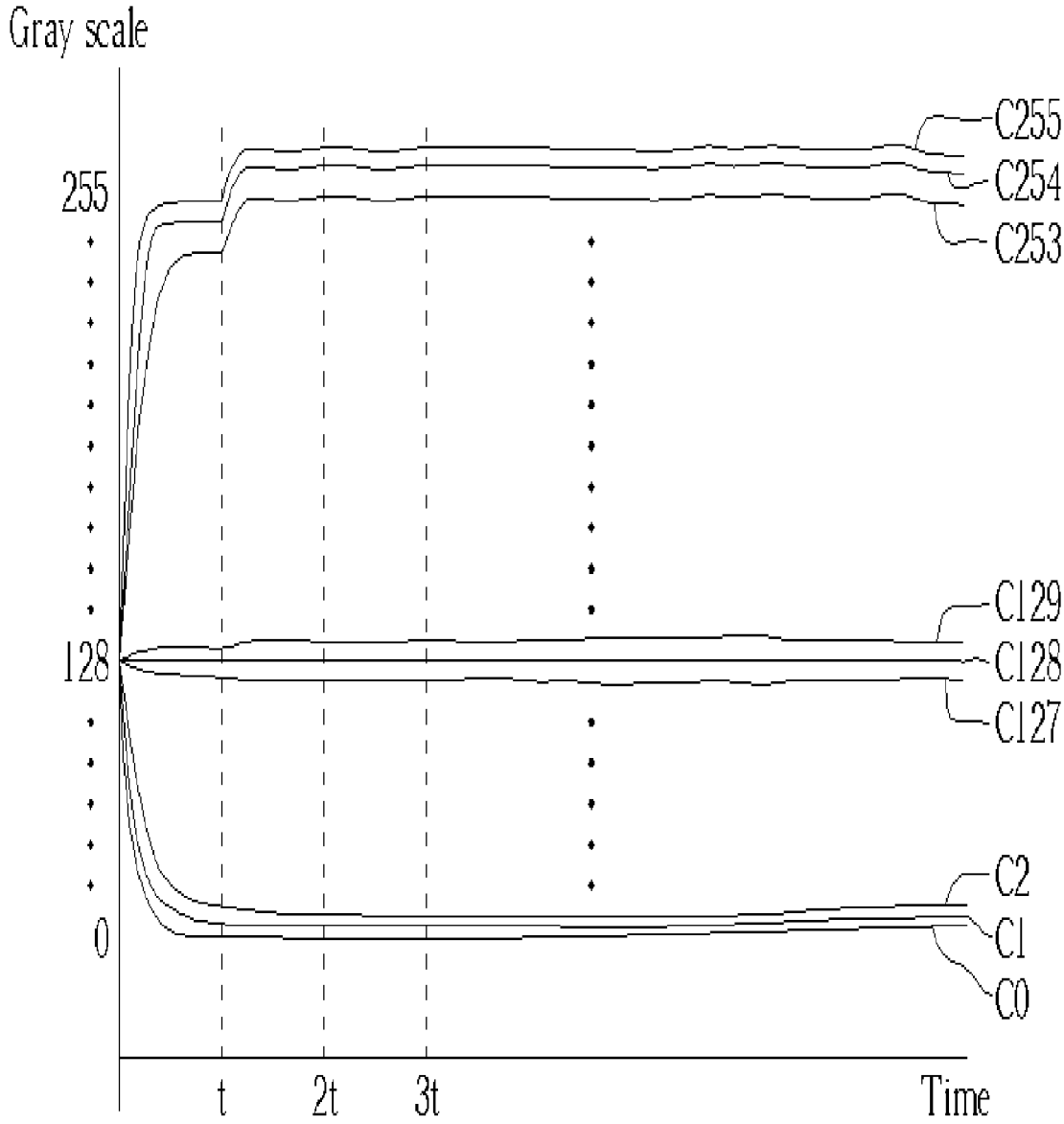
FIG. 6 illustrates the measured reaction curves of the LCD panel.

Additionally, in contrast to the prior art, which uses a processor to extract values in a table by interpolation, the image data values in the tables 52 according to the present invention are previously stored in the memory 50. Therefore, the driving circuit 40 according to the present invention does not require the processor for extraction as in the prior art. The image data values in the tables 52 are obtained by measuring the LCD panel 31 so that the driving circuit 40 can overdrive the LCD panel 31 correctly without an operation such as interpolation as in the prior art. Please refer to FIG. 6 showing the measurement of reaction curves of the LCD panel 31. Before determining the overdrive image data in the table 52, reaction curves representing a pixel 36 switching from any gray scale value to other gray scale values in a frame period t can be measured. FIG. 6 shows the reaction curves C0~C255 representing the pixel 36 switching from a gray scale value 128 to any other gray scale values (0~255). In the case of measuring the LCD panel 31 used in the above examples, since the pixel 36 is switched among 256 gray scales, there are 256 reaction curve diagrams like FIG. 6 shown respectively for the pixel 36 switching from one gray scale value (0~225) to other gray scale values within a frame period t.

Figure 7:
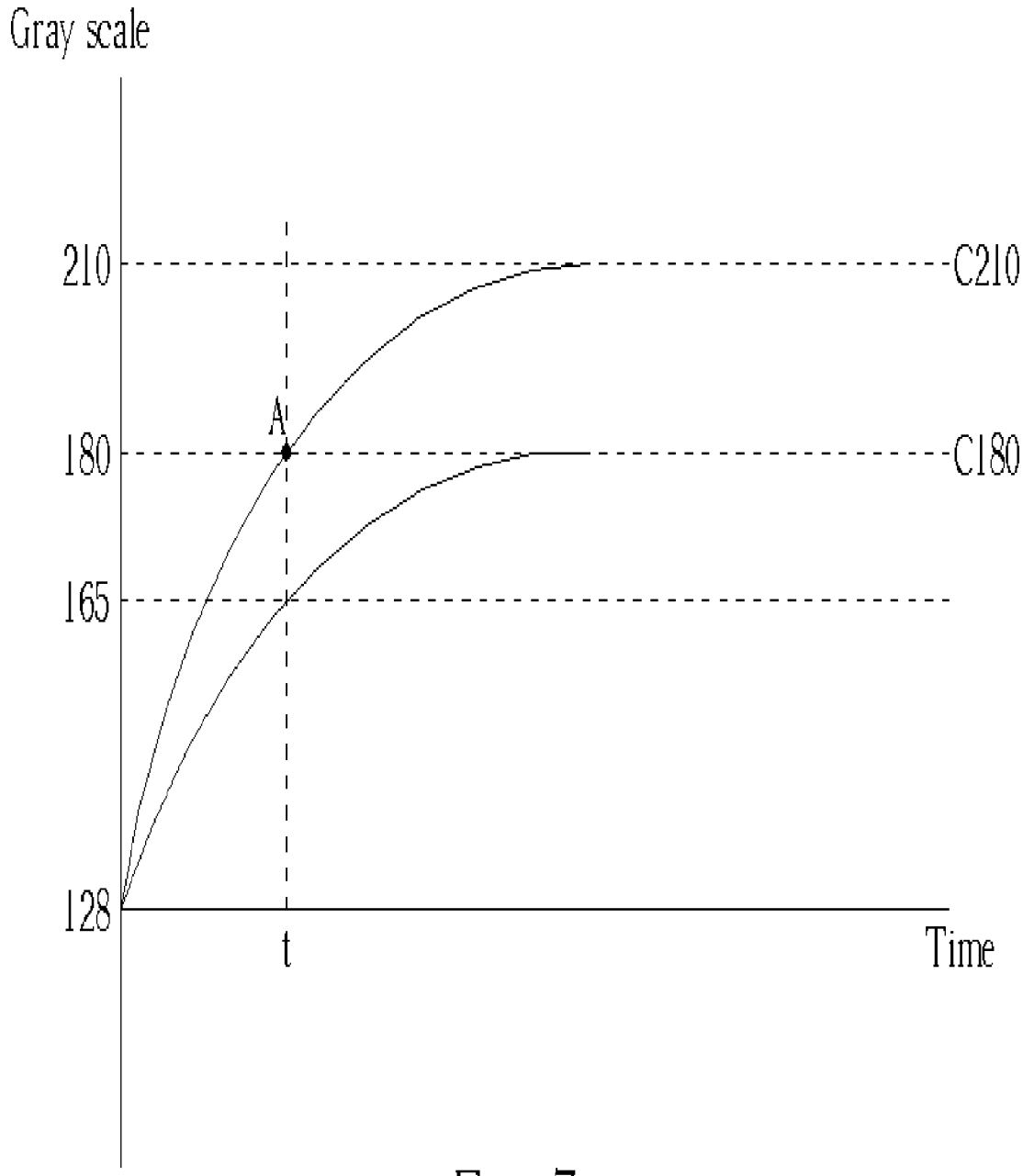
FIG. 7 illustrates the method to determine overdrive image data in the table.

Please refer to FIG. 7 showing the method used to determine overdrive image data in the table 52. Take a pixel 36 switched from gray scale value 128 to gray scale value 180 for an example. As shown in FIG. 7, if the pixel electrode 39 of the pixel 36 is subject to a data voltage corresponding to gray scale 180, the gray scale is not able to reach 180 in a frame period t. Thus, an overdrive voltage is required to be applied to the pixel electrode 39 of the pixel 36. Therefore, the data voltage required to have the pixel electrode 39 of the pixel 36 switch from the gray scale value 128 to 180 in a frame period can be known by using the reaction curves C0~C225 in FIG. 6. The method to determine overdrive image data is as follows:

(1) Find an intersection A (as shown in FIG. 7) between a vertical line of frame period t and a horizontal line of the gray scale value 180 in FIG. 6; and (2) Determine which one of the reaction curves C0~C225 is closer to A. Image data (or gray scale value) corresponding to the reaction curve closer to A is the required overdrive image data.

In the said example, since the reaction curve corresponding to image data 210 passes A, the required overdrive image data for the pixel 36 switched from gray scale value 128 to 180 is 210. Moreover, each table 50 stores ($2^8 \times 2^8$) 8-bit overdrive image data, and each piece of the image data is obtained by measuring the LCD panel 31. In addition, please notice that during the gray scale switching of the pixel 36, if the difference between two neighboring gray scales is too large (e.g. 128 to 255) so that the switching cannot be completed in a frame period t, the overdrive data value will be 0 or 255, wherein 0 is for a high gray scale value to a low gray scale value, and 255 is for a low gray scale value to a high gray scale value.

Figure 8:
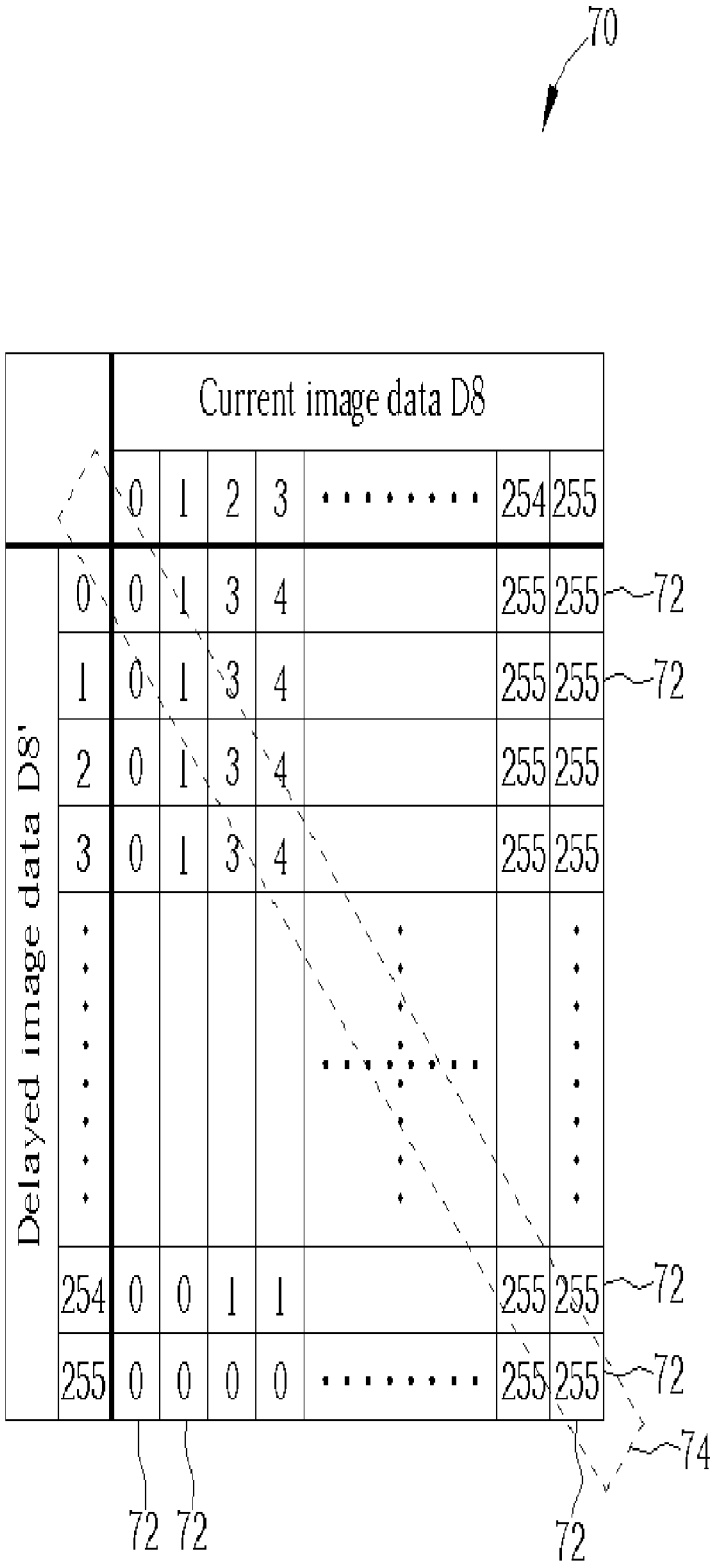
FIG. 8 illustrates a table in FIG. 5 whose gamma is adjusted.

In addition, the table 60 in FIG. 5 obtained by measurement is defined as a standard table. The overdrive image data 62 in the column along a diagonal line 64 from the upper-left to the lower-right equals to the corresponding delayed image data D8 and the corresponding image data D8. That means the gamma of the table 60 has not been adjusted, i.e. the gamma corresponding to the table 60 is 1. Compared with the table 60 in FIG. 6, FIG. 8 shows a table 70 whose gamma has been adjusted. Being the same as the standard table 60, the table 70 is selected from the plurality of tables 52 in the memory 50, and it stores a plurality of overdrive image data 72 for the LUT 48. The difference is that in the table 70, the gamma is adjusted so that all the overdrive image data 72 in the columns along the diagonal line 74 do not necessarily equal to the corresponding delayed image data D8 and the corresponding image data D8. Moreover, the overdrive image data 72 in the table 70 is relative to the overdrive image data 62 in the table 60 because the overdrive image data 72 is obtained through the following steps:

(1) Measure an adjustment gray scale value of every gray scale value of the pixel 36 for a specific gamma. Take the table 70 for example. Now measure all the overdrive image data 72 in the columns along the diagonal line 74; and (2) Solve other overdrive image data 72 to fill in the rest of the table (i.e. the spaces not along the diagonal) by using the adjustment gray scale value and the standard table 60. To solve for an image data value 72 on the table 70, find the diagonal image data 72 located on the same row i.e. D8 as the image data 72 that needs to be solved. Replace the D8 coordinate with the diagonal image data 72 value and look up the value using the new coordinates on the standard table 60. The image data value 62 located at the new coordinates is the value of the image data 72 to be solved. Take the overdrive image data 72 located at (D8, D8)=(2, 1) in the table 70 for example. The overdrive image data 72 in the column along the diagonal line 74 and on the same line as (2,1) has an the image data value of 3. Replacing the old D8 coordinate (2) with the image data value of 3, the new coordinates become (3,1) after adjustment. Using the new coordinates on table 60, it is found that the image data 62 has a value of 1. By this way, it can be known that the overdrive image data 72 (D8, D8)=(2, 1) in the table 70 is equal to the overdrive image data 62 (D8, D8)=(3, 1) in the table 60, the overdrive image data being equal to 1.

Moreover, tables 50 corresponding to other gammas can be generated according to the method mentioned above. Measure overdrive image data in columns along a diagonal line of each table 50, and then solve other overdrive image data according to the standard table 60 and the overdrive data in the columns along the diagonal line.

Additionally, when the liquid crystal molecules are twisted according to data voltage change, the response time of the twisting differs according to the temperature of the LCD panel 31. For better performance under various temperature, the driving circuit 40 selects the table according to the temperature of the LCD panel 31 by generates temperature compensation signals St sending them to the table selector 54 so that the table selector 54 selects a table from the plurality of tables 52 stored in the memory 50, according to both gamma and the temperature compensation signals St, and transmits the selected table to the LUT 48.

In contrast to the prior art, the tables according to the present invention are built by actually measuring the over-driving voltages needed for properly driving the liquid crystal panel within a frame period. The tables include all the over-driving image data that drives the pixels from any gray scale to another so that the processor used to extract the brief table is no longer required. Additionally, the driving circuit and the driving method of the present invention is capable of selecting different tables according to gamma and temperature of the LCD panel for the LUT.

Those skilled in the art will readily observe that numerous modifications and alterations of the device and method may be made while retaining the teachings of the invention. Accordingly, the above disclosure should be construed as limited only by the metes and bounds of the appended claims.

The invention claimed is:

1. A driving method of a liquid crystal display (LCD), the LCD comprising:

an LCD panel, the LCD panel comprising:

a plurality of scan lines;

a plurality of data lines; and a plurality of pixels, each pixel being connected to a corresponding scan line and a corresponding data line, and each pixel comprising a switching device connected to the corresponding scan line and the corresponding data line; and the method comprising:

(a) measuring reaction curves of the pixels of the LCD panel switched from any gray scale value to other gray scale values in a frame period, and generating a standard table according to the reaction curves measured;

(b) measuring adjustment gray scale values of any gray scale value for different gammas;

(c) generating a plurality of tables according to the adjustment gray scale values and the standard table;

(d) applying scan voltages to the scan lines;

(e) receiving image data from an image signal terminal;

(f) delaying the image data for a frame period in order to generate delayed image data;

(g) selecting a table from the standard table and the tables according to gamma; and (h) selecting an image data value from the selected table according to the current image data and the delayed image data and generating a data line voltage according to the image data value, applying the generated data line voltage on a corresponding data line.

2. The method of claim 1 further comprising:

(i) generating temperature compensation signals according to temperature of the LCD panel; and (j) selecting the table from the standard table and the tables according to the gamma and the temperature compensation signals in step (g).

3. A driving method of a liquid crystal display (LCD), the LCD comprising:

an LCD panel, the LCD panel comprising:

a plurality of scan lines;

a plurality of data lines; and a plurality of pixels, each pixel being connected to a corresponding scan line and a corresponding data line, and each pixel comprising a switching device connected to the corresponding scan line and the corresponding data line;

the method comprising:

(a) applying scan voltages to the scan lines;

(b) receiving image data from an image signal terminal;

(c) delaying the image data for a frame period in order to generate delayed image data;

(d) selecting a table from the standard table and the tables according to gamma; and (e) selecting an image data value from the selected table according to the current image data and the delayed image data, and generating a data line voltage according to the image data value, applying the generated data line voltage on a corresponding data line.

4. The method of claim 3 further comprising:

(f) measuring reaction curves of the pixels of the LCD panel switched from any gray scale value to other gray scale values in a frame period, and generating a standard table according to the reaction curves measured.

5. The method of claim 4 further comprising:

(g) measuring adjustment gray scale values of any gray scale value for different gammas;

(h) generating a plurality of tables except the standard table according to the adjustment gray scale values and the standard table.

6. The method of claim 3 further comprising:

(i) generating temperature compensation signals according to temperature of the LCD panel; and (j) selecting the table from the standard table and the tables according to the gamma and the temperature compensation signals in step (d).

7. A driving circuit for driving an LCD, the LCD comprising:

an LCD panel, the liquid crystal panel comprising:

a plurality of scan lines;

a plurality of data lines; and a plurality of pixels, each pixel being connected to a corresponding scan line and a corresponding data line, and each pixel having a switching device connected to the corresponding scan line and the corresponding data line;

the driving circuit comprising:

a scan line driving circuit for applying scan voltages to the scan lines;

an image signal terminal for receiving image data;

an image memory for storing the image data and delaying the image data for a frame period;

a memory for storing a plurality of tables;

a selector for selecting a table from the plurality of tables according to gamma;

a look up table for selecting an image data value from the selected table according to the current image data and the delayed image data; and a data line driving circuit for generating a data voltage according to the image data value and applying the data voltage to a corresponding data line.

8. The driving circuit of claim 7 further comprising a thermal sensor for sensing temperature of the LCD panel and generating temperature compensation signals according to the temperature, and the selector selecting the table from the plurality of tables stored in the memory according to gamma and the temperature compensation signals.

* * * * *

UNITED STATES PATENT AND TRADEMARK OFFICE

CERTIFICATE OF CORRECTION

PATENT NO. : 7,148,869 B2
APPLICATION NO. : 10/707384
DATED : December 12, 2006
INVENTOR(S) : Cheng-Jung Chen et al.

It is certified that error appears in the above-identified patent and that said Letters Patent is hereby corrected as shown below:

Title page, item [73] assignee: should read --Vastview Technology Inc.--

Signed and Sealed this

Twentieth Day of March, 2007

JON W. DUDAS
*Director of the United States Patent and Trademark Office*